United States Patent [19]

Muus

[11] 4,384,465

[45] May 24, 1983

[54] LOCK MECHANISM

[75] Inventor: Frank Muus, Moss, Norway

[73] Assignee: Elkem-Spigerverket a/s, Olso, Norway

[21] Appl. No.: 164,596

[22] Filed: Jun. 30, 1980

[30] Foreign Application Priority Data

Jul. 5, 1979 [NO] Norway ..... 792235

[51] Int. Cl.[3] ..... E05B 65/06; E05C 1/12

[52] U.S. Cl. ..... 70/129; 70/472; 292/172; 292/DIG. 27

[58] Field of Search ..... 70/129, 472, 134; 292/172, DIG. 27

[56] References Cited

U.S. PATENT DOCUMENTS

| | | | |
|---|---|---|---|
| 470,474 | 3/1892 | Colley | 70/129 |
| 1,169,659 | 1/1916 | Lowell | 292/DIG. 27 X |
| 1,968,285 | 7/1934 | Egan | 292/172 |
| 4,047,408 | 9/1977 | Johns et al. | 70/129 |
| 4,061,370 | 12/1977 | Hauber | 292/DIG. 46 X |

FOREIGN PATENT DOCUMENTS

| | | | |
|---|---|---|---|
| 218803 | 2/1910 | Fed. Rep. of Germany . | |
| 1130794 | 10/1956 | France | 70/129 |
| 614424 | 12/1960 | Italy | 70/129 |
| 1246441 | 9/1971 | United Kingdom . | |
| 1402701 | 8/1975 | United Kingdom . | |
| 1458758 | 12/1976 | United Kingdom . | |

*Primary Examiner*—William E. Lyddane

*Attorney, Agent, or Firm*—Eyre, Mann, Lucas & Just

[57] ABSTRACT

The invention relates to a lock mechanism for doors, preferably for use with dwellings, apartments or offices, the locking mechanism providing in particular a measure of safety against unauthorized opening of the lock. The lock mechanism is of a type which at will may be alternatively actuated from the inside either by a key or a thumb turn. When the resident of the house leaves he may in a simple manner suspend the function of the thumb turn. The lock is on its inside equipped both with a key hole hand and a thumb turn. The thumb turn may be engaged or disengaged with a dead bolt by means of a screw means. The screw means is actuated from the front of the lock, actuating an arm which actuates a transmission element bringing the transmission means of the thumb turn into, respectively out of engagement with the transmission means on the follower so that the lock at the operators will either will be actuated by a key or a thumb turn.

4 Claims, 6 Drawing Figures

LOCK MECHANISM

The invention relates to a lock mechanism for doors, preferably for use with dwellings, apartments or offices, the locking mechanism providing in particular a measure of security against unauthorized opening of the lock.

Conventional door locks are arranged to be actuated either by applying a key from both sides of the door, or by applying a key from one side only, the lock being actuated from the opposite side by a thumb turn. The latter variant is a commonly preferred, simple and efficient solution since the lock may be actuated from the inside without being dependent on the use of a key. Due to the thumb turn on the inside, however, unauthorized opening of the door becomes relatively simple, mainly since an intruder only need to knock a hole in the door window, if any; put his hand through the hole and open the lock by turning the thumb turn on the inside.

It is desirable to be able to actuate the lock from the inside by means of a thumb turn during periods when the house is attended, while when leaving the house on holidays etc., it is desirable to have a lock which cannot be actuated from the inside by means of the thumb turn.

This problem is solved using a lock mechanism which at will may be alternatively actuated from the inside either by a key or a thumb turn. When the resident of the house leaves he may in a simple manner suspend the function of the thumb turn.

According to the present invention the lock is on the same side equipped with both a key hole and a thumb turn which, when set, is interconnected to the dead bolt, activating said bolt.

An embodiment of the present invention is schematically illustrated on FIGS. 1–6 where FIG. 1 shows the lock assembly in perspective;

FIGS. 3 and 4 show a vertical section along line A—A on FIG. 1, where the lock is actuated by a thumb turn and a key respectively; while

Figure 1:
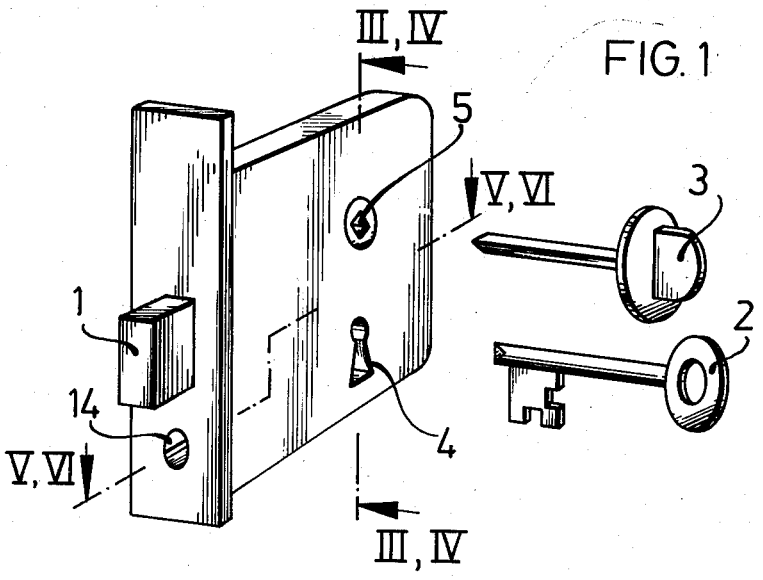

On the Figures 1 denotes the locking means or the dead bolt. 2 is the key and 3 is the thumb turn with corresponding holes 4 and 5 respectively. The lock is intended to be installed in a door in a conventional manner and the thumb turn may also be supported by conventional key hole roses.

Figure 2:
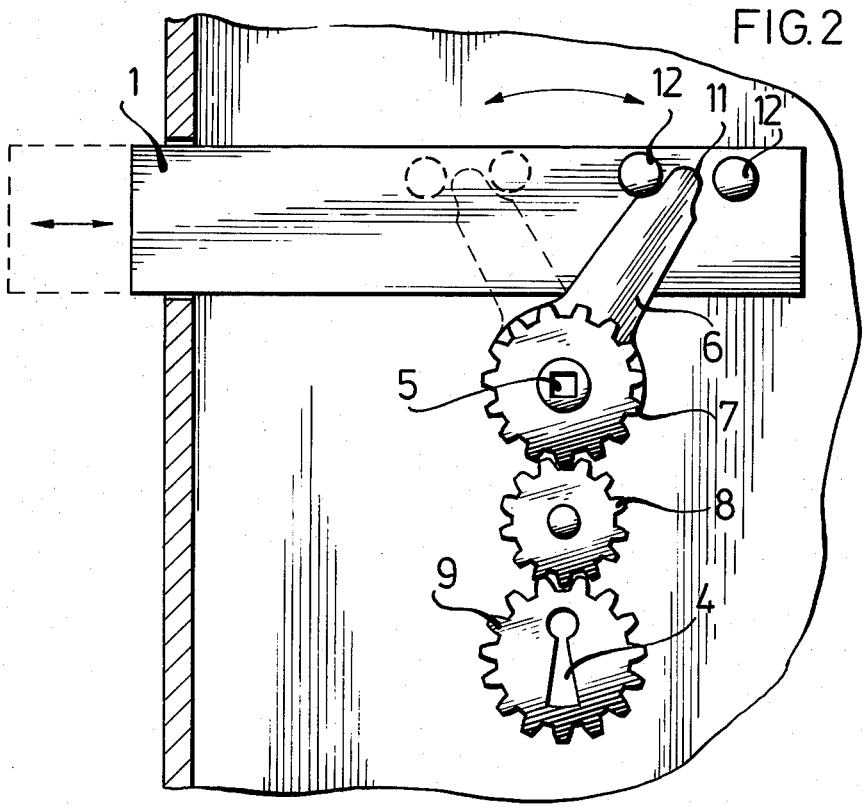
FIG. 2 shows a sectional view of the lock assembly.

FIG. 2 shows the mechanism for actuating the locking means (dead bolt) 1, the locking mechanism 1 moving between two ultimate positions by means of a follower 6 equipped with a pinion 7. The follower 6 is by means of a pinion 8 actuated either by the thumb turn 3 introduced into a square hole 5 or by means of a key 2 introduced into the key hole 4. The key code, the tumblers and the recesses which are based on conventional principles, are arranged inside the pinion 9 and will not be described in further detail.

Figure 3:
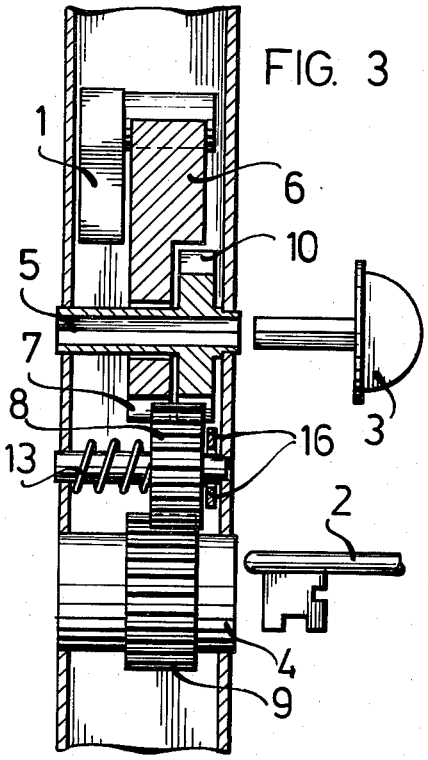

FIG. 3 shows how the pinion 8 interact with the follower 6, the pinion 7 and the pinion 9 through the gear rim 10. The follower 6 actuates the dead bolt 1 through the flange 11 and the pins 12 (FIG. 2). The pinion 8 may be moved in axial direction relatively to pinions 7, 10 and 9, but is normally kept in engagement with both the pinion 10 and the follower 6 with its pinion by means of a spring 13.

Figure 4:
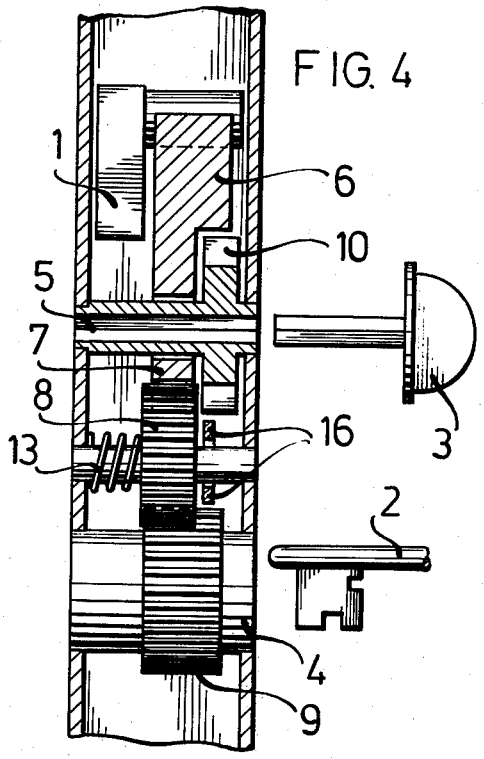

FIG. 4 shows the pinion 8 disengaged with the pinion 10, the pinion 8 being engaged only with the pinion 9 and the pinion 7 on the follower 6. The pinion 10 and the thumb turn is now disengaged and the lock must be actuated by the key 2.

Figure 5:
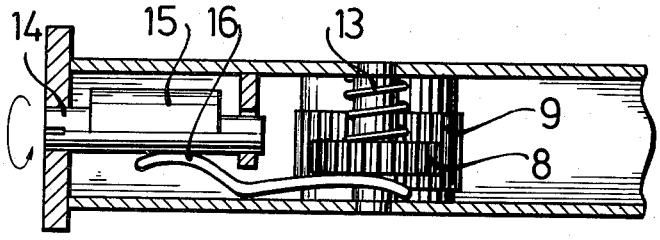
FIGS. 5 and 6 show a horizontal section through the lock assembly along line B—B on FIG. 1, when the lock is actuated by the thumb and the key respectively.
Figure 6:
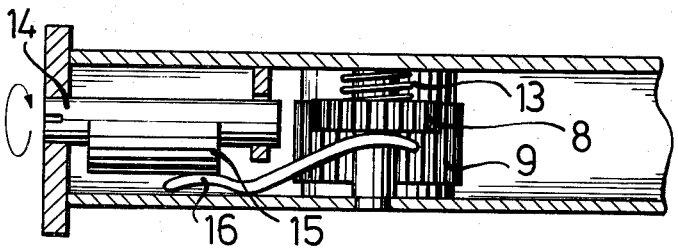

A rotatable member 14 having a slotted head with an eccentric portion 15 is arranged in the front of the lock (FIGS. 5 and 6). The screw means 14 may be rotated by means of the key which for this purpose has a screw driver shaped tip whereby the eccentric portion 15 will actuate the arm 16, bringing the pinion 8 into gear or out of gear with the pinion 10 actuated by the thumb turn 3.

It should readily be appreciated that the embodiment shown on the Figures only represent one out of several possible solutions. The pinion may for example be substituted by other types of rotational transmission means. The key may for example be arranged so as to directly come into contact with the teeth on the pinion 8 and that the elements denoted as pinions may be segments of such pinions. The transmission of motion between the components may be achieved using mechanical transmission means other than pinions.

I claim:

1. A lock comprising:

(a) a dead bolt;

(b) a follower engaging said dead bolt for movement thereof;

(c) a first pinion;

(d) a second pinion affixed to said follower;

(e) said first pinion engaging said second pinion and being operative for rotating said second pinion for movement of said follower;

(f) key means including a third pinion engaging said first pinion for rotation thereof whenever said third pinion is rotated;

(g) thumb-turn means including a fourth pinion;

(h) spring means for holding said fourth pinion in engagement with said first pinion; and (i) a rotatable member having at least a first position and a second position, said rotatable member in one of said positions being operative to move said first pinion against said spring means out of engagement with said fourth pinion whereby said first pinion is not rotatable by said fourth pinion when said rotatable member is in said one of said positions and said first pinion is rotatable by said fourth pinion when said screw means is in the other of said positions.

2. A lock comprising:

(a) locking means;

(b) transmission means for actuating said locking means, said transmission means comprising a first pinion engaging a second pinion having a follower thereon, said follower engaging said locking means for actuation thereof;

(c) key means engaging said transmission means for actuation of said first pinion;

(d) thumb-turn means; and (e) means for selectively moving said first pinion into and out of engagement with said thumb-turn means wherein said locking means is actuatable only by said key means when said thumb-turn means is out of engagement with said first pinion and by either said thumb-turn means or said key means when said first pinion is engaged with said thumb-turn means.

3. The lock of claim 2 wherein the means for moving said first pinion comprises an arm engaging said first pinion and a rotatable member, said rotatable member also having an eccentric portion which upon rotation of said rotatable member is operative to engage said arm for movement of said first pinion.

4. The lock of claim 3 further comprising a spring for normally forcing said first pinion into engagement with the thumb-turn means.

* * * * *